United States Patent [19]

Sortwell et al.

[11] 3,949,937

[45] Apr. 13, 1976

[54] SYSTEM FOR HANDLING AND APPLYING A NON-SUSPENDED REFRACTORY SLURRY

[75] Inventors: Edwin T. Sortwell; David S. Kerr, both of Wheaton, Ill.

[73] Assignee: Nalco Chemical Company, Oak Brook, Ill.

[22] Filed: Jan. 29, 1975

[21] Appl. No.: 545,172

[52] U.S. Cl. ..... 239/70; 239/112; 239/127; 239/176

[51] Int. Cl.[2] ..... B05B 12/02

[58] Field of Search ..... 164/267, 72; 118/7, 302; 239/67, 70, 112, 113, 127, 142, 160, 165, 175, 176, 172, 191, 263, 373, 380

[56] References Cited

UNITED STATES PATENTS

| | | | |
|---|---|---|---|
| 2,210,934 | 8/1940 | Gleason | 239/113 |
| 2,343,842 | 3/1944 | Hatcher | 164/72 X |
| 3,276,695 | 10/1966 | Giardino et al. | 239/176 X |
| 3,341,124 | 9/1967 | Barnes | 239/112 X |
| 3,396,935 | 8/1968 | Snyder | 164/72 X |
| 3,462,081 | 8/1969 | Gelin et al. | 239/112 X |
| 3,653,594 | 4/1972 | Bok et al. | 239/70 |
| 3,833,175 | 9/1974 | Pulk | 239/176 X |

*Primary Examiner*—John J. Love

*Attorney, Agent, or Firm*—Lockwood, Dewey, Zickert & Alex

[57] ABSTRACT

System for handling and applying a non-suspended refractory slurry to ingot stools used in the production of steel ingots, including an apparatus capable of selectively applying refractory slurry to ingot stools which receives slurry from a storage tank. An agitator is provided in the tank to continually agitate the slurry, and wet air is used to clean the lines carrying the slurry when they are not being used for application of slurry to prevent clogging.

11 Claims, 8 Drawing Figures

FIG. 5
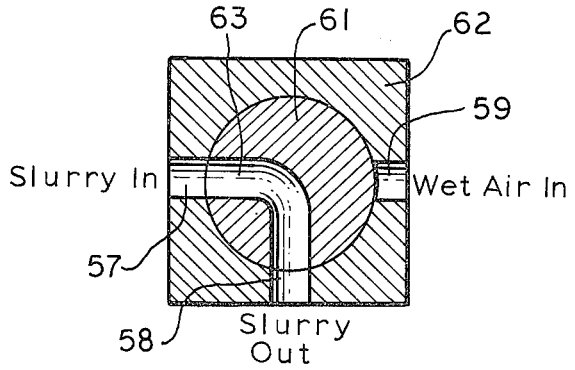
FIG. 6
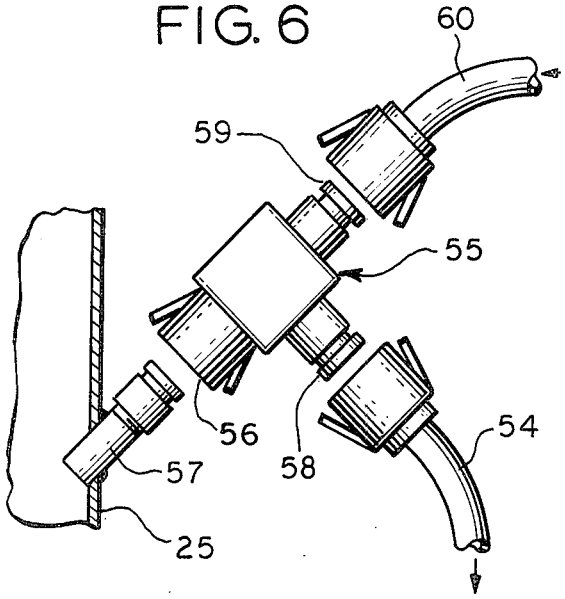
FIG. 7
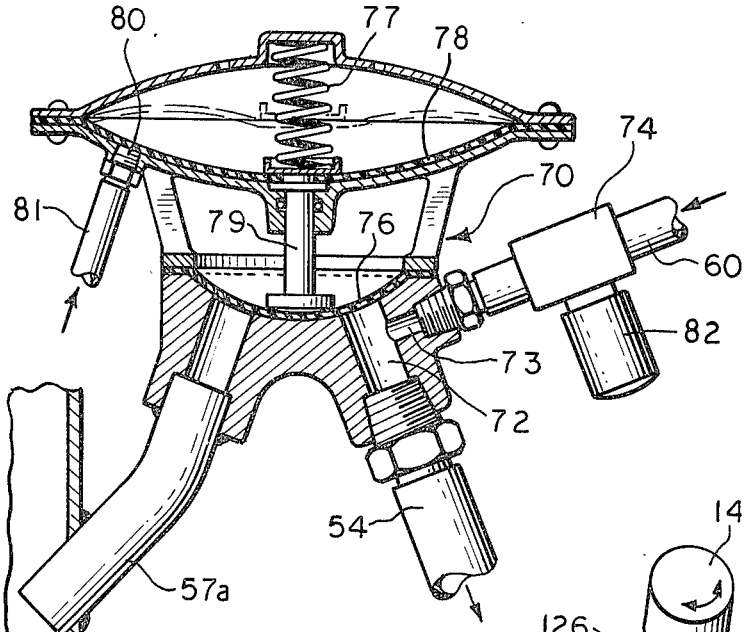
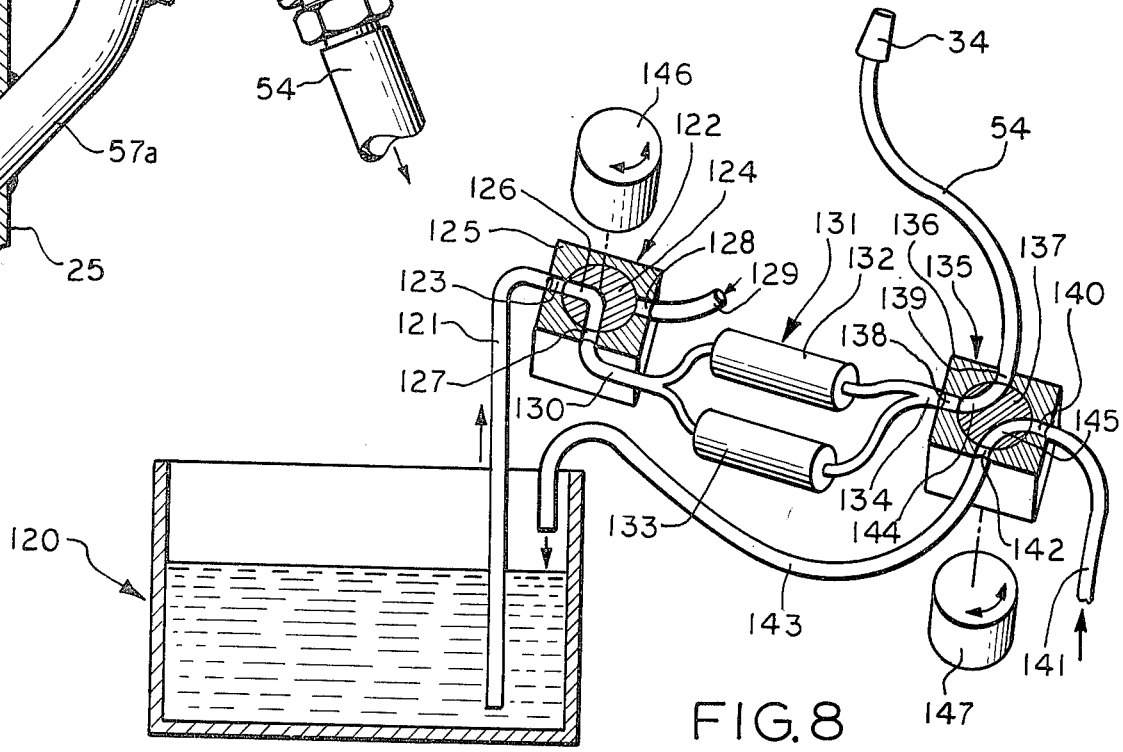
FIG. 8

SYSTEM FOR HANDLING AND APPLYING A NON-SUSPENDED REFRACTORY SLURRY

This invention relates in general to a system for handling and applying non-suspended refractory slurries to ingot forming parts such as stools used in steel ingot production, and more particularly to an apparatus capable of providing reliable intermittent slurry application of a non-suspended slurry.

Production of steel ingots requires the use of ingot molds and stools which are made of steel. Molten steel at a temperature of about 2900° F. is poured into an ingot mold resting on a stool during the making of steel ingots. Continued use of the ingot molds and stools causes wear in the area of the stools against which the molten steel impinges during pouring and where the mold abuts the stool, which after a time results in the production of undesirably shaped ingots. This problem is largely overcome by coating the ingot mold and stool with a refractory slurry which, when dried, will substantially, if not completely, eliminate mold and stool wear caused during pouring.

It is well known to use refractory slurries for coating of ingot molds and stools. One type of slurry is referred to as a non-suspended slurry, while another type is referred to as a suspended slurry. The non-suspended slurry is made up just prior to use by mixing a refractory grain with a liquid binder, while a suspended slurry is provided to the user in its final form. An example of a known non-suspended refractory slurry is one including as one component refractory grain in the form of fused silica or quartz silica and a liquid binder in the form of a colloidal suspension of silica in water. Preferably, a fused silica is employed. The refractory grain and liquid binder are usually mixed equally by weight. A specific example of a refractory grain is one sold under the trademark "NALCOTE 87OP" by Nalco Chemical Company of Chicago, Illinois. This refractory grain is in the form of powdered fused silica. A satisfactory liquid binder is one sold under the trademark "NALCOTE 88OL," also by Nalco Chemical Company of Chicago, Illinois, and which is in the form of a colloidal suspension of silica in water. Such a refractory slurry is difficult to handle because it is necessary to maintain the slurry under agitation at all times to prevent settling of the refractory grain, and difficulty has been encountered by equipment used to handle it heretofore because of the quick settling tendency of the refractory grain when the slurry is not under agitation.

Accordingly, it has been heretofore preferred to use a suspended refractory slurry such as one sold under the trademark "NALCOSIL" by Nalco Chemical Company of Chicago, Illinois.

Under certain conditions, the performance of a suspended refractory slurry may equal that of a non-suspended refractory slurry. Where the temperature of the stool does not exceed about 250° F., the suspended refractory slurry will dry or cure and provide a coating which will perform essentially equal to that of a non-suspended refractory slurry. However, the stool temperature is usually much higher and in the range of about 300° to 600° F., although it can even be as high as 700° to 800° F., and when this temperature range is encountered, bubbles form in the coating of a suspended refractory slurry during the attempt of water and steam to escape. These bubbles are undesirable and do not provide the refractory coating that will give the best performance. The drying of a non-suspended slurry at these high temperatures will not cause the formation of as many bubbles as the water and steam can better escape, and therefore a much better refractory coating is obtained for better performance. Accordingly, it is preferable to use the non-suspended refractory slurry.

Heretofore, the problems encountered in the handling and applying of a non-suspended refractory slurry have been such that even while the performance of the product is better, the handling and application of the product usually made its use impractical. The present invention overcomes the handling and application problems heretofore encountered to thereby permit the practical use of a non-suspended refractory slurry in the coating of ingot molds and stools used in the production of steel ingots and thereby makes it feasible and desirable to use the better performing non-suspended refractory slurry.

A steel mill utilizing a non-suspended refractory slurry in accordance with the present invention does so in conjunction with a nearby blending plant which prepares the non-suspended refractory slurry by mixing a refractory grain and a liquid binder. The slurry is delivered under agitation from the blending plant to the steel mill in a suitable delivery tank. According to the invention, a mill slurry storage tank receives the slurry and maintains it under agitation by means of a suitably driven agitator. Alternately, the delivery tank may be used as a mill storage tank. More specifically, a mechanical agitator is provided within the tank and may be driven by an electric or air motor.

A spray application unit for applying the slurry to ingot molds and/or stools is connected to the storage tank with a unique delivery system. Inasmuch as the spray application unit will be intermittently operated for application of slurry coatings, it is necessary to properly condition the spray application unit and the delivery system between the storage tank and the unit between applications in order to prevent malfunctioning, for it must be appreciated here that a non-suspended slurry to be effective must be maintained under agitation at all times. Stopping movement of a non-suspended refractory slurry allows the gravitational settling of the refractory grain which cannot be tolerated.

The delivery system between the storage tank and spray application unit includes control valve means and lines. The spray application unit is connected to the lines and includes a nozzle and wobulator assembly having a nozzle being driven by a wobulator for effecting uniform coating of the slurry onto a designated surface. While the present invention will be explained in connection with coating of stools, it should be recognized modification of the spray application unit would render it suitable for coating molds. Means is provided according to the present invention to automatically clear the delivery system between slurry application cycles. During normal operation, the slurry in the tank is maintained under constant agitation. Between slurry coating applications, the delivery system is cleared with wet air. A timing control accurately measures the volume of refractory slurry applied during a given cycle. When slurry is not being delivered to the spray application unit, the lines and nozzle are cleared by flushing same with wet air.

It is therefore an object of the present invention to provide a unique method and apparatus for handling and applying non-suspended refractory slurry to ingot forming parts used in the production of steel ingots.

It is a further object of the present invention to provide an apparatus for handling and applying nonsuspended refractory slurries which is capable of providing reliable intermittent slurry applications.

Another object of the invention is to provide an apparatus for applying coatings of non-suspended refractory slurries to ingot stools including a delivery system and spray application unit that is cleared with wet air between spray application cycles.

A still further object of the present invention is in the provision of apparatus for accurately applying a given volume of slurry for coating ingot stools.

Other objects, features and advantages of the invention will be apparent from the following detailed disclosure, taken in conjunction with the accompanying sheets of drawings, wherein like reference numerals refer to like parts, in which:

FIG. 5 is a sectional and partly diagrammatic view of one form of three-way valve used for the spray application unit of the apparatus of the invention;

FIG. 6 is a somewhat exploded view of the valve of FIG. 5 and showing how it is connected into the apparatus of the invention;

FIG. 7 is a modified three-way valve for the spray application unit; and

FIG. 8 is a somewhat diagrammatic view of a modified slurry handling circuit for the apparatus of the invention where the slurry tank need not be pressurized.

Figure 1:
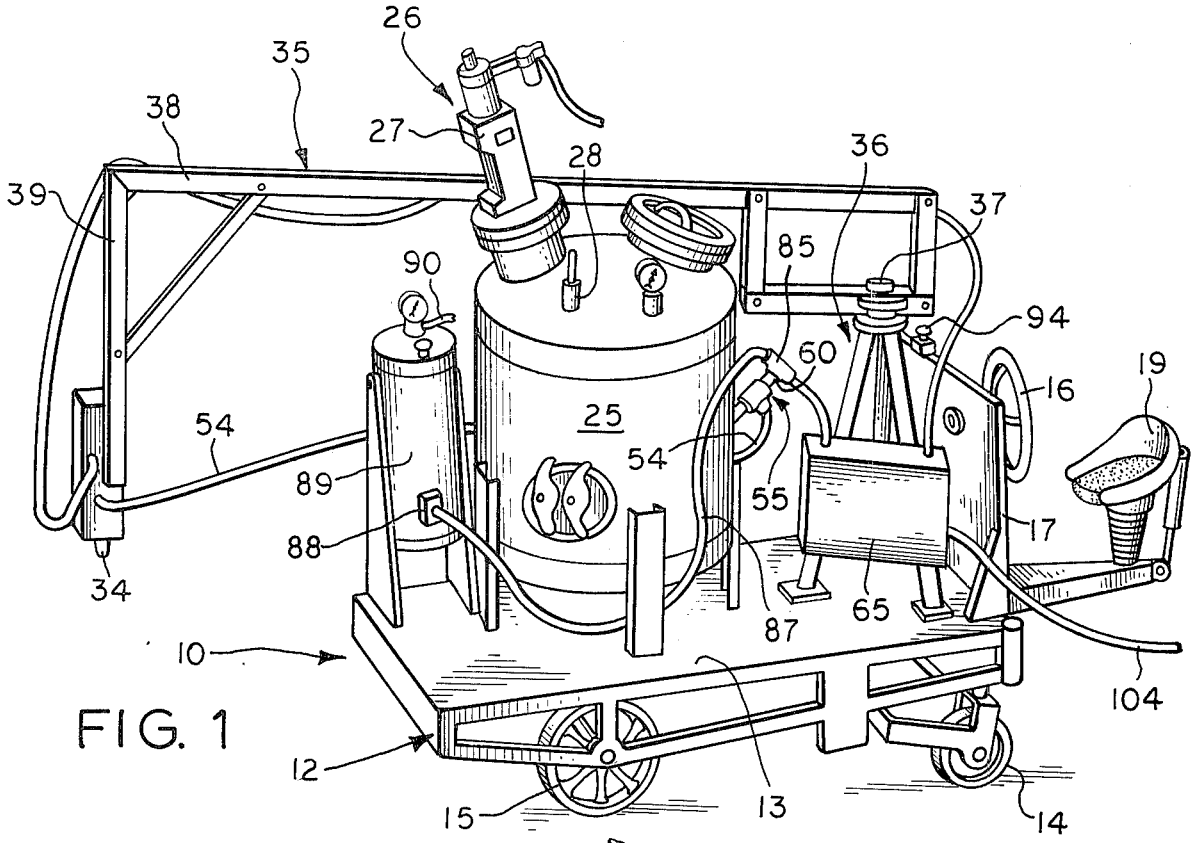
FIG. 1 is a perspective view of the slurry handling apparatus of the invention showing the nozzle boom positioned over the mobile support platform as arranged when the unit is moved to a coating station with some parts broken away and others omitted for purposes of clarity.
Figure 2:
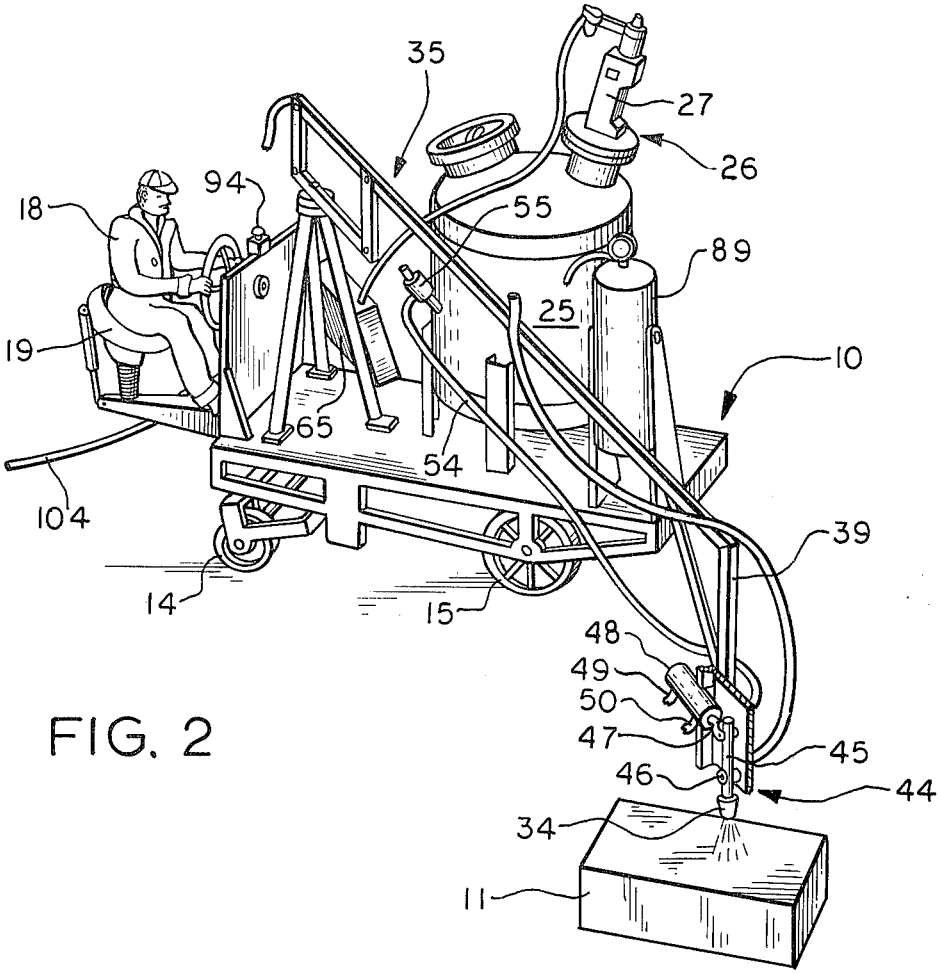
FIG. 2 is a perspective view of the apparatus of FIG. 1, looking at it from the opposite direction and illustrating the nozzle boom extending laterally from the unit for a spray coating operation and with some parts broken and other parts omitted for purposes of clarity.

Referring now to the drawings and particularly to FIGS. 1 and 2, the slurry handling apparatus of the invention, generally designated by the numeral 10, can readily be seen as a mobile unit that may be moved from a storage station to a coating station and also between coating stations, it being appreciated here that the unit will be used in a large steel mill and where it is necessary to space steel ingot forming stations such distances apart that a mobile unit becomes practical. The mobile unit would therefore be moved to a position where an ingot forming part need be coated with the non-suspended refractory slurry to protect the ingot forming part against undue wear. As seen particularly in FIG. 2, an ingot forming part 11 in the form of a stool is shown being coated with a slurry by the apparatus 10 of the invention. It should be recognized that modification of the delivery end of the apparatus would facilitate coating ingot molds, although for purposes of this application reference will be made to coating of ingot stools.

The slurry handling apparatus includes a wheeled vehicle or buggy chassis 12 upon which the various elements for handling the slurry are mounted and transported. The chassis 12 is defined by a platform or support 13 having wheels 14 and 15. The wheels 14 are suitably steerable through a steering wheel 16 mounted on an upstanding panel 17 by an operator 18 in a seat 19 carried by the chassis 12. While not shown in FIGS. 1 and 2, but as will be more clearly understood hereinafter, a suitable drive motor will be connected to the wheels 15 for powering the apparatus.

The slurry is carried by a slurry tank 25 mounted on the platform 13 and maintained under constant agitation by an agitator 26 that is continually operating when slurry is loaded into the tank. It can here be appreciated that the slurry may be taken from a stationary storage tank at one location and transferred to the tank on the apparatus, after which the apparatus may be moved to an ingot forming station where it will be used for coating of stools. A suitable opening is provided in the slurry tank for loading of same. It can also be appreciated the agitator will include a suitable mechanically driven paddle or mixing device located within the tank but not shown here and driven by an air motor 27. Moreover, air is supplied within the tank through the fitting 28 to place the slurry under pressure.

The slurry is discharged from the apparatus through a nozzle 34 of a suitable type carried on the end of a nozzle boom 35. The nozzle boom is pivotally mounted on top of a tripod support 36 extending upwardly from the platform 13 of the chassis at a suitable pivot 37. The nozzle boom includes an elongated horizontally extending arm 38 projecting from the pivot 37 and having at its outer end a downwardly or generally vertically extending leg 39. The nozzle 34 is suitably mounted at the lower end of the leg 39. The boom 35 is normally carried over the platform 13, as shown in FIG. 1, when the apparatus is driven from one station to another, and then manually pivoted laterally of the chassis, as shown in FIG. 2, for positioning the nozzle over a stool for application of a slurry.

In order to provide a relatively uniform thickness of slurry coating on a stool, the slurry nozzle 34 is mounted on a wobulator 44 that is suitably supported on the leg 39 of the nozzle boom 35. The wobulator may take any suitable form which will oscillate the nozzle during the coating operation or the spray application cycle. One form of wobulator is shown diagrammatically in FIG. 2 which includes a crank arm 45 pivotally mounted at 46 on the leg 39. The lower end of the crank arm 45 has the nozzle 34 suitably carried thereon, while the upper end is pivotally connected to a piston rod 47 of a double-acting pneumatic motor 48. Commencement of a spray application cycle also commences operation of the motor 48 which reciprocates the piston rod 47 and thereby oscillates the slurry nozzle 34 where lines 49 and 50 are connected to the motor 48 and to suitable control mechanism for causing air prssure to be applied to opposite ends of the cylinder during operation of the motor. While not shown, it can be appreciated here that a rotary air motor can be utilized with an eccentric and slide crank mechanism for also giving oscillating movement to the nozzle 34.

The slurry nozzle 34 is connected to a slurry line 54 that is in turn connected to a control valve 55 mounted on the slurry tank 25. The control valve may also be defined as a spray application unit valve. The form of control valve shown in FIGS. 1 and 2 is more particularly shown in FIG. 6 and diagrammatically shown in FIG. 5 and includes a slurry inlet port 56 that is connected to a fitting 57 on the tank 25 and therefore in communication with the slurry in the tank. A slurry outlet 58 is connected to the slurry line 54 and therefore in communication with the nozzle 34. A third port in the form of a wet air inlet 59 is connected to a source of wet air through a wet air line 60. Operation of the valve may be understood by reference to FIG. 5, wherein a plug 61 in the valve housing 62 includes a passageway 63 which may be alternately positioned to provide communication between the slurry inlet 56 and the slurry outlet 58 during a spray application cycle or communication between the wet air inlet 59 and the slurry outlet 58 for clearing the slurry line 54 and nozzle following a spray application cycle.

The nozzle 34 and the wobulator 44 may be termed the spray application unit of the apparatus, while the control valve or spray application unit valve 55 and the slurry line 54 may be termed the delivery system. Because of the quick settling characteristics of a non-suspended refractory slurry, it is necessary to clear the delivery system and spray application unit between spray application cycles to avoid clogging which would cause malfunction of the apparatus. The valve 55 is air actuated between the positions of the plug 61 by suitable control means mounted in a control box 65. To facilitate maintenance of the valve 55, it is provided with quick disconnect couplings, as shown in FIG. 6, so that it may be quickly and easily removed and replaced, if necessary.

An alternate form of control valve is shown in FIG. 7 and designated by the numeral 70, and which includes a slurry inlet port 71, a slurry outlet port 72, and a wet air inlet port 73. The slurry inlet port 71 is connected to the slurry tank 25 through a short fitting 57*a*, while the slurry outlet port is connected to the slurry line 54 leading to the nozzle 34. The wet air inlet port 73 is connected to the wet air line 60 through a suitable on-off valve 74. The slurry inlet and outlet ports 71 and 72 are selectively connected to one another through a chamber formed in the valve housing 75 upon movement of a rubber or flexible diaphragm 76. The diaphragm 76 is normally held in its closed position, as shown in solid lines in FIG. 7, by the action of a return spring 77 against an actuating diaphragm 78 that is connected to a plunger 79. Opening of this valve is effected by pressurizing the lower side of the diaphragm 78 through an air inlet 80 connected to an air line 81 and a suitable source of air which drives the diaphragm upwardly against the force of the spring 77 and also drives the plunger 79 upwardly, whereupon the pressurized slurry forces the closure diaphragm 76 upwardly to interconnect the inlet and outlet ports 71 and 72. Through suitable controls the wet air valve 74 operated by an air actuator 82 closes off the wet air supply when the slurry valve is open and delivers wet air to the slurry outlet 72 when the slurry valve is closed so that the delivery system and spray application unit can be cleared of slurry. In order to avoid settling problems with the slurry, it can be seen in FIGS. 6 and 7 that the fittings 57 and 57*a* are inclined so that the solids will fall back into the tank when the slurry valves are closed between spray application cycles. Preferably, the slurry line 54 is slightly downwardly inclined from its connection from the slurry control valve to the nozzle so that during clearing of the delivery system and spray application unit the gravitational forces on the solids of the slurry will assist in properly clearing the slurry line and nozzle.

Wet air is produced by combining water and air at a mixing tee 85 which is connected to an air line 86 and a water line 87. The water line is connected through a rotometer 88 to a supply of water carried in a water tank 89 supported on the platform 13 and maintained under pressure through a suitable air inlet line 90. The rotometer 88 controls the volume of water to the mixing tee 85 and can adjust the water volume as needed.

Figure 3:
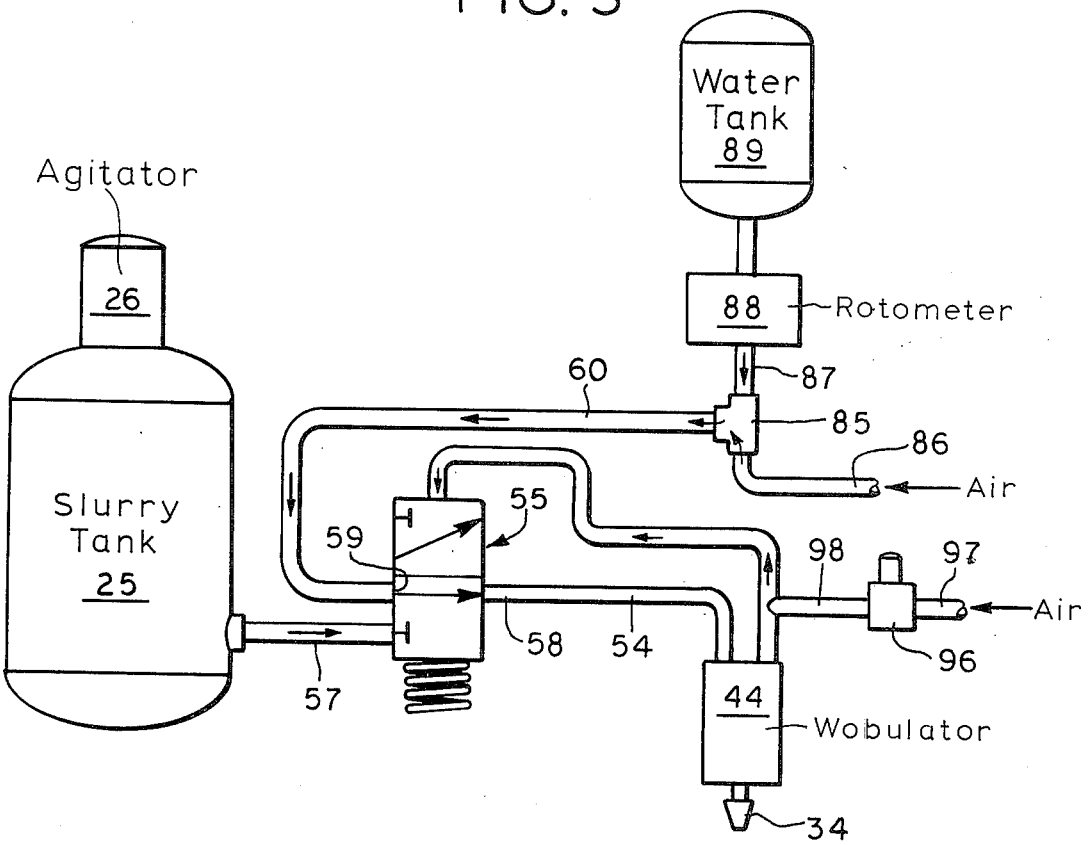
FIG. 3 is a generally diagrammatic view of the slurry and wet air circuit for the apparatus of the invention.

Commencement of a spray application cycle by the operator is accomplished by operating the control button 94 mounted on the top of the panel 17. The control button actuates an air valve and timer assembly 96, shown in FIG. 3, which supplies air from the air inlet line 97 to an air outlet line 98 that simultaneously supplies air to the wobulator 44 to commence oscillation of the nozzle 34 and to the spray application valve 55 to connect the slurry inlet 56 to the slurry outlet 58. The air valve and timer assembly 96 may be suitably adjusted to provide a timed cycle that will measure a given amount of slurry to be discharged from the slurry nozzle 34 and to provide a suitable coating of slurry on the stool. At the end of the timed cycle, the air supply to the spray application unit valve 55 and the wobulator 44 will be discontinued, and a return spring 100 will cause the valve 55 to connect the wet air line 60 to the slurry line 54 for clearing of the delivery system and spray application unit. Accordingly, the wet air will flush the slurry line 54 and the nozzle 34, thereby preventing the settling of the solids of the slurry in the slurry line or nozzle and thereby prevent clogging that would cause malfunction during a subsequent spray application cycle. When the next spray application cycle is commenced, the wet air supply is discontinued and in a short period of time the slurry line and nozzle is filled with slurry to commence the coating of a stool.

Figure 4:
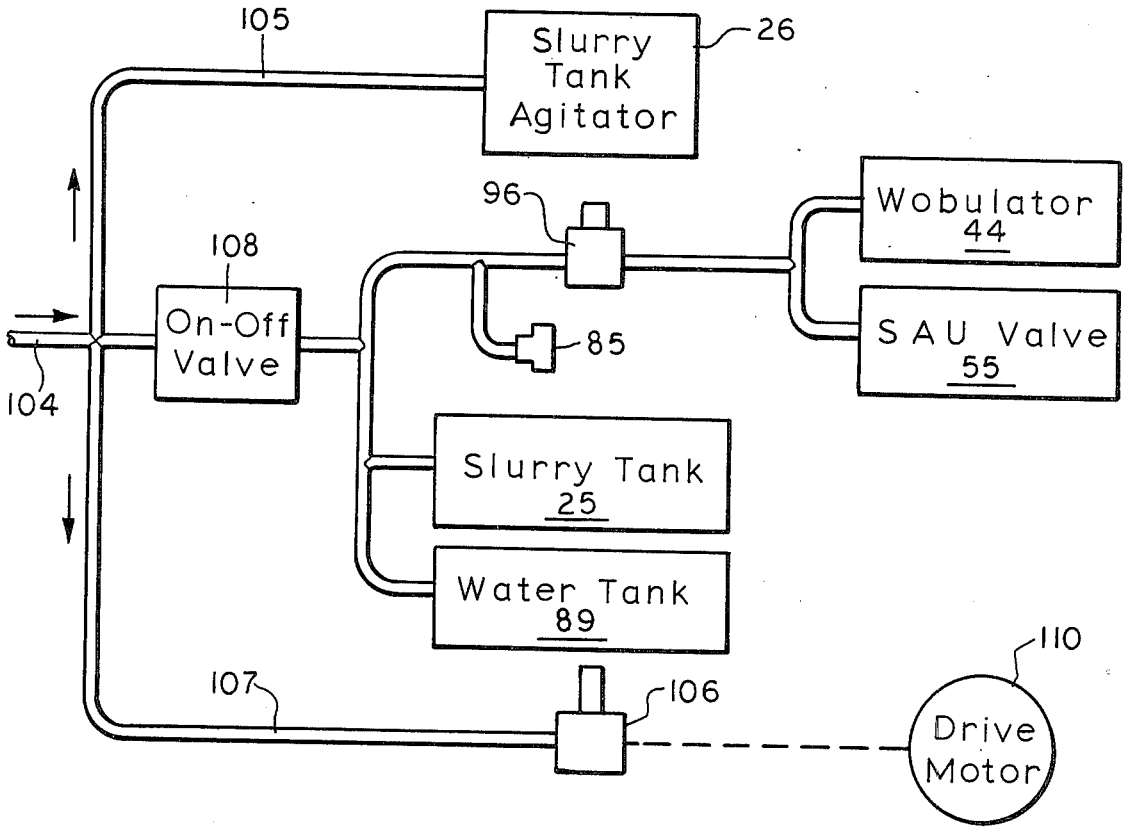
FIG. 4 is a generally diagrammatic view of the air circuit for the apparatus of the invention.

The air flow diagram may be better understood with reference to FIG. 4, where a main air line 104 provides the air supply to the slurry handling apparatus 10. This line would be connected to the mill air supply and when so connected would provide air to the slurry tank agitator through a line 105, a vehicle drive valve 106 through a line 107, and an on-off valve 108 mounted on the vehicle chassis.

Prior to commencement of preparing for a spray application cycle, the on-off valve 108 would be opened to provide an air supply to the air water mixing tee 85 for production of wet air, the slurry tank 25 and the water tank 89 for pressurizing same and the control valve and timer assembly 97. As already explained, when the control valve and timer 97 is actuated, an air supply is simultaneously provided to the wobulator 44 for driving same and the spray application unit valve 55 for operating same.

The vehicle drive valve 106 operates a drive motor 110 that is drivingly connected to the drive wheels 15 of the handling apparatus. The drive motor is therefore air actuated and can be actuated to drive the vehicle chassis in either direction. Accordingly, the entire power for the slurry handling apparatus is derived from an incoming air supply in line 104. It will be appreciated that suitable air control instrumentation is provided as needed for accomplishing the proper handling of the air supply.

A modification of the slurry flow circuit is shown in FIG. 8 which differentiates from the apparatus shown and explained in FIGS. 1 to 6, primarily in that the slurry tank is not pressurized and the slurry is forced through the nozzle by a pump. This embodiment includes a slurry tank 120 that may be open at the top but also provided with an agitator which is not shown. A suction line 121 leads from the slurry tank to a three-way valve 122 and particularly to a slurry inlet port 123. A plug 124 within a valve housing 125 is provided with a passageway 126 that selectively connects the slurry inlet port 123 to a slurry outlet port 127 or connects a wet air inlet port 128 to the slurry outlet port 127. The wet air inlet port is suitably connected through a line 129 through a source of wet air, while the slurry outlet port 127 is connected to a suction inlet line 130 of a pump 131. The pump 131 is of a type that is commercially available and includes a pair of pumping sections 132 and 133. Each pumping section includes a collapsible hose portion surrounded by an air chamber that may be alternately pressurized and exhausted to squeeze the flexible section flat and allow it to expand. At the inlet ends of each section which are connected to the suction inlet line 130, check valves are provided to only allow flow into the sections and at the outlet ends of the sections which are connected to a discharge line 134, check valves are provided to only permit discharge of slurry by alternately operating pumping sections 132 and 133. A relatively constant flow of slurry is established between the suction inlet line 130 and the discharge line 134 when the three-way valve 122 is conditioned to connect the slurry tank to the pump, A four-way valve 135 including a housing 136 having a rotatable plug 137 is provided with a slurry inlet port 138 connecting to the discharge line 134 of the pump 131, a slurry outlet port 139 connecting to the slurry line 54 and nozzle 34, a wet air inlet port 140 connecting to the wet air inlet line 141, and a slurry return port 142 connecting to a slurry return or recirculation line 143 that leads back to the slurry tank. Dual passageways 144 and 145 are provided in the plug 136 to selectively interconnect port 138 with port 139 and port 140 with port 142, or port 138 with port 142 and port 139 with port 140. A pneumatic actuator 146 is provided for operating the three-way valve 122 and a pneumatic actuator 147 is provided for actuating the four-way valve 135.

In operation, the system of FIG. 8 may have the valves 122 and 135 conditioned as shown where a spray application cycle will be in progress. The pump 131 is thereby effectively pumping slurry from the tank 120 to the nozzle 34, while the return or recirculation line 143 is being cleared or flushed with wet air. Between spray application cycles, the three-way valve 122 is conditioned to connect the wet air inlet port 129 with the slurry outlet port 127 and shut off the slurry inlet port 123, while the four-way valve 135 is conditioned to connect the discharge of the pump 131 to the return line 143 through connection of the slurry inlet port 138 and the return line port 142 and also to connect the wet air line to the slurry line 54 and nozzle 34 through the connection of the wet air inlet port 140 to the slurry outlet port 139. Accordingly, between spray application cycles, the pump 131 is being flushed with wet air and the residual slurry is being returned to the tank 120 and the slurry line 54 and nozzle 34 are being flushed with wet air. This will prevent clogging and render the apparatus ready for the next spray application cycle.

It will be understood that modifications and variations may be effected without departing from the scope of the novel concepts of the present invention, but it is understood that this application is to be limited only by the scope of the appended claims.

The invention is hereby claimed as follows:

1. Apparatus for handling and applying a non-suspended refractory slurry to steel ingot forming parts which comprises, a slurry storage tank, agitator means for said tank to continually agitate the slurry, a spray application unit, a delivery system interconnecting the tank and spray application unit having means for controlling spray application cycles, means for automatically clearing the delivery system and spray application unit between spray application cycles, said means for clearing the delivery system and spray application unit including means directing wet air through the delivery system and spray application unit having a pressurized water tank providing a source of water under pressure, a rotometer for providing a regulated water volume, a source of air, and a mixing tee for receiving the air and regulated water volume to provide a source of wet air, and valve means selectively connecting either said slurry storage tank or said source of wet air to said delivery system and spray application unit.

2. Apparatus as defined in claim 1, wherein said means for controlling spray application cycles includes timing means for regulating the timed length of a cycle.

3. Apparatus as defined in claim 1, wherein said storage tank includes means for maintaining the slurry under pressure.

4. Apparatus as defined in claim 1, wherein said spray application unit includes a nozzle and means for moving the nozzle during a spray application cycle to cause uniform coating over a given area.

5. Apparatus as defined in claim 4, wherein said nozzle moving means includes a wobulator.

6. Apparatus for uniformly coating a steel ingot forming part with a non-suspended refractory slurry which comprises, a wheeled support, a slurry tank mounted on the support, means for continually agitating the slurry in the tank, a nozzle for applying the slurry, a nozzle boom mounted on the wheeled support supporting the nozzle in spaced relation thereto, a three-way valve mounted on the tank having a slurry inlet port connected to a fitting on the tank, a slurry outlet port connected through a line to the nozzle and a wet air inlet port connected to a source of wet air, said source of wet air including a water tank, a mixing tee, means for metering water, means connecting the metered water to the mixing tee, and means connecting an air supply to the mixing tee, said valve including means for selectively connecting the slurry inlet and outlet ports during a slurry application cycle or connecting the wet air inlet and slurry outlet ports for flushing the line and nozzle, and means for operating the valve through a timed cycle during a slurry application cycle.

7. Apparatus as defined in claim 6, wherein means is provided to pressurize the slurry and water tanks.

8. Apparatus as defined in claim 6, wherein the agitator means includes an air motor for driving same.

9. Apparatus as defined in claim 6, which further includes means for mounting the nozzle and oscillating same during a slurry application cycle.

10. Apparatus as defined in claim 6, wherein the line between the slurry outlet port of the three-way valve and the nozzle is generally inclined downwardly to the nozzle, and the fitting at the slurry inlet port extends downwardly into the tank.

11. Apparatus for uniformly coating a steel ingor forming part with a non-suspended refractory slurry which comprises, a wheeled support, a slurry tank mounted on the support, means for continually agitating the slurry in the tank, a nozzle for applying the slurry, a nozzle boom mounted on the support supporting the nozzle in spaced relation thereto, means pivotally mounting the nozzle boom on the support, a three-way valve mounted on the tank having a slurry inlet port connected to a fitting on the tank, a slurry outlet port connected through a line to the nozzle and a wet air inlet port connected to a source of wet air, the line between the slurry outlet port of the three-way valve and the nozzle being generally inclined downwardly to the nozzle, and the fitting at the slurry inlet port extending downwardly into the tank, said valve including means for selectively connecting the slurry inlet and outlet ports during a slurry application cycle or connecting the wet air inlet and slurry outlet ports for flushing the line and nozzle, and means for operating the valve through a timed cycle during a slurry application cycle.

* * * * *